US011927409B2

(12) United States Patent
Costet et al.

(10) Patent No.: US 11,927,409 B2
(45) Date of Patent: Mar. 12, 2024

(54) FIRING MECHANISM WITH SECONDARY INTERFACE FOR A FIREARM

(71) Applicant: FN America, LLC, McLean, VA (US)

(72) Inventors: Olivier Holger Costet, Columbia, SC (US); Jonathan Howard Derrick, Columbia, SC (US)

(73) Assignee: FN Herstal, S.A., Herstal (BE)

( * ) Notice: Subject to any disclaimer, the term of this patent is extended or adjusted under 35 U.S.C. 154(b) by 272 days.

(21) Appl. No.: 17/471,930

(22) Filed: Sep. 10, 2021

(65) Prior Publication Data

US 2023/0083557 A1 Mar. 16, 2023

(51) Int. Cl.

| | |
|---|---|
| ***F41A 19/14*** | (2006.01) |
| ***F41A 17/82*** | (2006.01) |
| ***F41A 19/10*** | (2006.01) |
| ***F41A 19/12*** | (2006.01) |

(52) U.S. Cl.

CPC ..... *F41A 19/14* (2013.01); *F41A 17/82* (2013.01); *F41A 19/10* (2013.01); *F41A 19/12* (2013.01)

(58) Field of Classification Search

CPC ..... F41A 17/82; F41A 19/44; F41A 19/45

See application file for complete search history.

(56) References Cited

U.S. PATENT DOCUMENTS

| | | | | |
|---|---|---|---|---|
| 2,690,095 A * | 9/1954 | Earle | F41A 17/76 | 89/149 |
| 3,402,498 A * | 9/1968 | Freitag | F41A 17/74 | 42/41 |
| 4,023,465 A * | 5/1977 | Inskip | F41A 19/03 | 89/142 |
| 4,208,947 A * | 6/1980 | Hillberg | F41A 17/74 | 42/70.08 |
| 4,399,628 A * | 8/1983 | Franchi | F41A 17/74 | 42/42.01 |
| 5,614,691 A * | 3/1997 | Taylor | F41A 11/02 | 89/181 |
| 7,600,338 B2 | 10/2009 | Geissele | | |
| 8,893,607 B2 * | 11/2014 | Audibert | F41A 19/14 | 42/69.01 |
| 8,985,006 B1 | 3/2015 | Christensen et al. | | |
| 9,310,150 B1 | 4/2016 | Geissele | | |
| 9,562,731 B2 | 2/2017 | Geissele | | |
| 9,863,730 B2 | 1/2018 | Elftmann | | |

(Continued)

FOREIGN PATENT DOCUMENTS

| | | |
|---|---|---|
| EP | 0399984 | 11/1990 |
| GB | 575000 | 1/1946 |

(Continued)

OTHER PUBLICATIONS

European Patent Office, International Search Report and Written Opinion for International Patent Application No. PCT/IB2022/058581, dated Dec. 20, 2022.

*Primary Examiner* — Gabriel J. Klein
(74) *Attorney, Agent, or Firm* — Williams Mullen; Thomas F. Bergert

(57) ABSTRACT

A firing mechanism provides a secondary interface between a hammer and a sear of a firearm that will automatically be engaged in case a primary interface between the hammer and the sear fails. In various embodiments, an actuator is employed to facilitate engagement of the primary and secondary interfaces.

18 Claims, 5 Drawing Sheets

(56) References Cited

U.S. PATENT DOCUMENTS

| | | | | |
|---|---|---|---|---|
| 10,648,755 | B1 | 12/2020 | Christiansen | |
| 11,162,752 | B2 * | 11/2021 | Elftmann, Jr. | F41A 19/16 |
| 2009/0183414 | A1 * | 7/2009 | Geissele | F41A 19/10 42/69.03 |
| 2013/0174459 | A1 | 7/2013 | Moretti | |
| 2015/0153126 | A1 | 6/2015 | Bender | |
| 2015/0330734 | A1 * | 11/2015 | Kolev | F41A 19/27 42/69.01 |
| 2020/0318925 | A1 * | 10/2020 | Christiansen | F41A 17/74 |
| 2020/0386503 | A1 | 12/2020 | Moretti | |
| 2022/0307788 | A1 * | 9/2022 | Bender | F41A 17/46 |
| 2023/0243609 | A1 * | 8/2023 | Muska | F41A 3/66 42/69.01 |

FOREIGN PATENT DOCUMENTS

| | | |
|---|---|---|
| GB | 2312041 | 10/1997 |
| WO | 2020050749 | 3/2020 |

* cited by examiner

FIRING MECHANISM WITH SECONDARY INTERFACE FOR A FIREARM

TECHNICAL FIELD

The present disclosure relates to firearms and, more particularly, to a firing mechanism for a firearm.

BACKGROUND

The retention/arming of a hammer in a traditional hammer-fired firing mechanism for a firearm is done by a surface on the hammer that interacts with a corresponding surface on a sear. This interface is typically protected from unintentional disconnection by using a balanced sear, a spring to bias the sear's position in relation to the hammer, and/or an interface geometry that produces a positive engagement between the hammer and sear surfaces.

One major shortcoming of such an interface is that the hammer will not be retained in the event the interface is physically damaged and fails to keep the two parts engaged. Another issue resulting from an interface failure is that, particularly in auto-loading weapons, the hammer can "follow" a slide or operating group after being reset and fire additional rounds without the user further manipulating the trigger, essentially rendering the firearm in fully automatic mode until the magazine is empty. While external safeties can be added to reduce the risk of a discharge in case the hammer-sear interface fails, such external safeties are not automatically activated and must be manually set.

SUMMARY

Embodiments of the present disclosure address the above problems and more by providing a secondary interface between the hammer and sear of a firearm that will automatically be engaged in case the primary interface fails. In various embodiments, the secondary safety interface is part of the hammer and sear and does not require any additional components.

According to embodiments of the present disclosure, in the event of a primary interface failure, the secondary safety interface will engage without any further action and will hold the hammer in its "armed" position. Further, embodiments of the secondary interface, when activated, disconnect the hammer and the sear from the trigger, creating a locked-out condition. Manually cycling the slide or operating group of the weapon will not allow the secondary interface to be separated and the secondary interface will re-engage every time until the weapon is disassembled for repair. The locked-out mechanism, among other things, allows for a safe disassembly of the weapon. As such, the presently disclosed firing mechanism with secondary interface provides significant safety against unintentional discharge of the firearm in case of part failures.

DETAILED DESCRIPTION OF EMBODIMENTS

Figure 1:
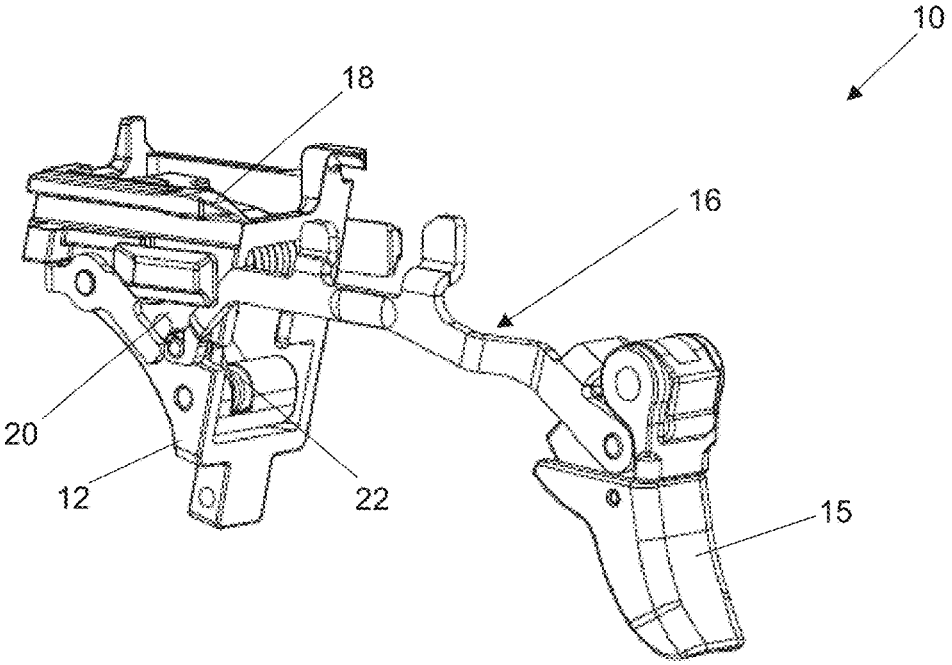
FIG. 1 is a perspective view of elements of a firing mechanism according to embodiments of the present disclosure.
Figure 2:
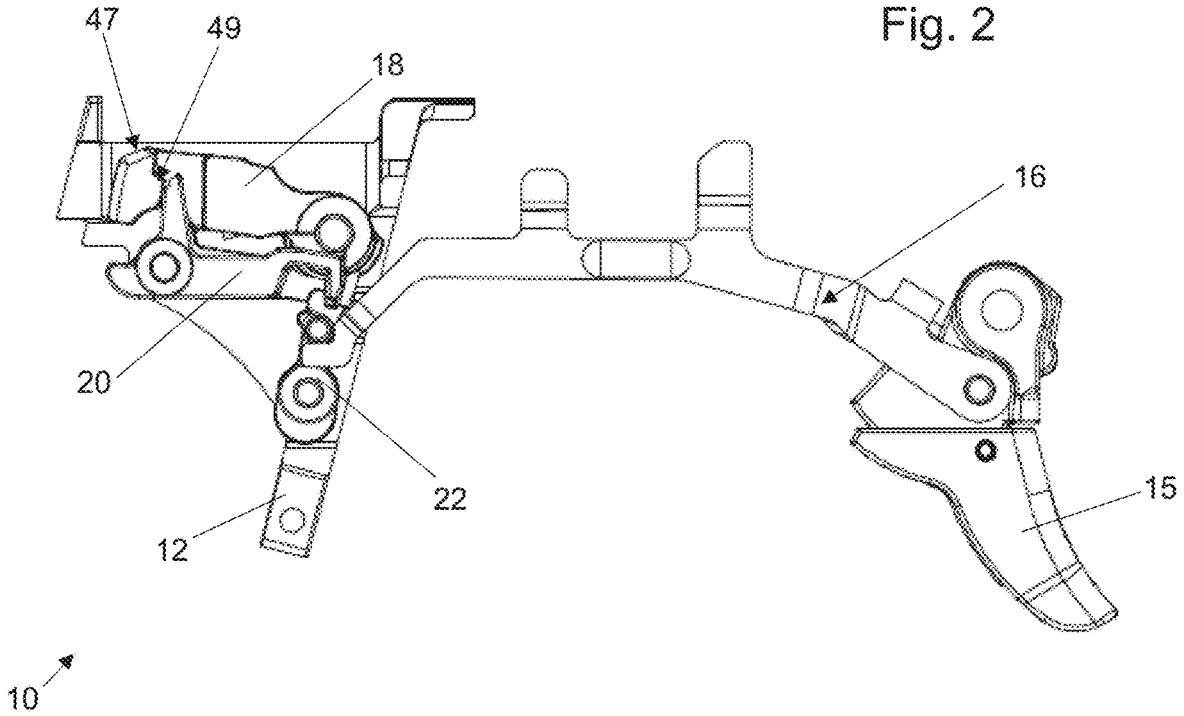
FIG. 2 is a side view of elements of a firing mechanism according to embodiments of the present disclosure.
Figure 3:
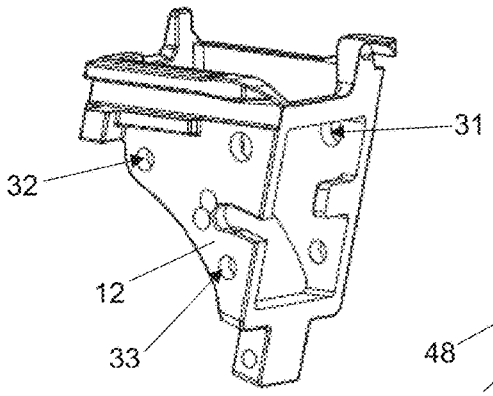
FIG. 3 is a perspective view of a frame or housing of a firing mechanism according to embodiments of the present disclosure.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

It will be appreciated that reference to "a", "an" or other indefinite article in the present disclosure encompasses one or more than one of the described element. Thus, for example, reference to a spring encompasses one or more springs, reference to a round encompasses one or more rounds, and so forth.

As shown in FIGS. 1 through 10, a firing mechanism 10 according to embodiments of the present disclosure includes a trigger group frame or housing 12, a trigger 15, a trigger bar 16, a hammer 18, a sear 20 and an actuator 22. It will be appreciated that embodiments of the firing mechanism 10 can involve a subset of these elements, such as the hammer 18, sear 20 and actuator 22, for example.

Figure 4:
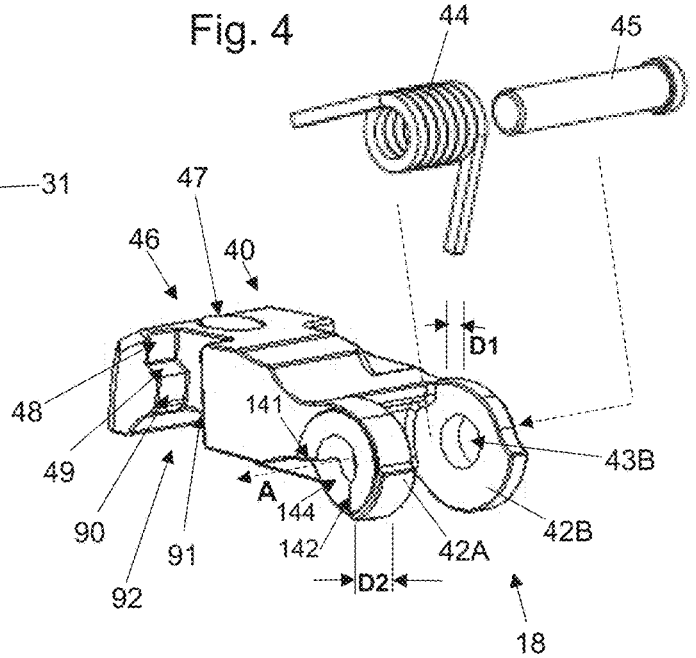
FIG. 4 is an exploded perspective view of a hammer according to embodiments of the present disclosure.

As shown in FIG. 4 and other figures, the hammer 18 is formed with a body 40 and opposed legs 42A and 42B, each of which includes a respective opening 43A, 43B for receiving a hammer spring 44 and a hammer pin 45. Leg 42B can be formed as a rim of constant thickness or depth D1 that forms the opening 43B, whereas leg 42A can be formed as a rim having a wider depth D2 for approximately three quarters of the rim and a narrower depth (not shown) for approximately one quarter of the rim. Leg 42A is thus formed with an internal wall 144 on the narrower depth portion extending between a leading edge 141 and a trailing edge 142 of the wider depth portion D2. In this way, the hammer 18 provides a cavity 145 in which a portion of the sear 20 to resides during operation as described herein. A hammer head segment 46 is formed with the body 40 and extends away from the opposed legs 42A and 42B. The hammer head segment 46 includes a striking face 47 which impacts a firing pin (not shown) during operation of the firearm. The hammer head segment 46 is further formed with a rampart wall 48 extending downwardly from the striking face 47 and a latching edge 49 extending laterally inwardly toward the legs 42A and 42B from the rampart wall 48. A sear facing wall 90 extends from the latching edge 49 and lies opposite a hammer slot wall 91, wherein the sear facing wall 90 and the hammer slot wall 91 form an opening 92 for receiving a sear extension arm 80 of the sear 20 during operation.

Figure 5:
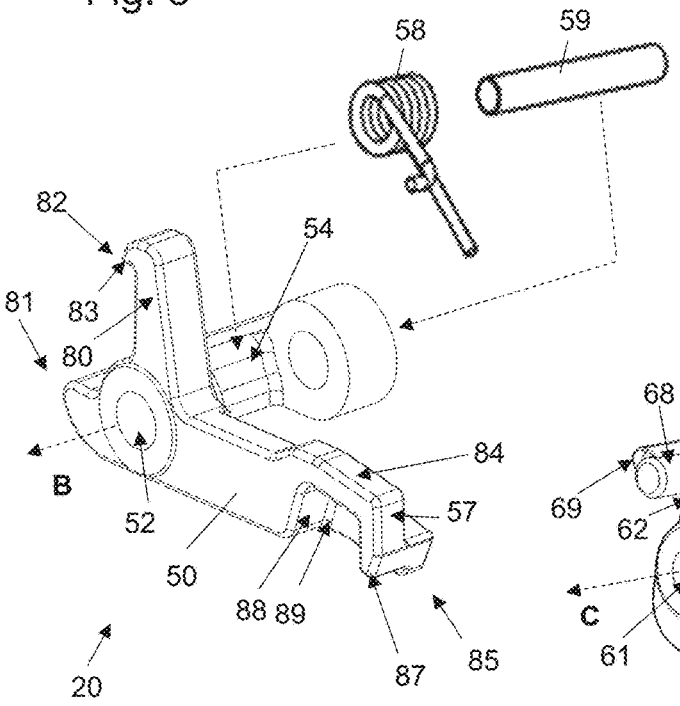
FIG. 5 is an exploded perspective view of a sear according to embodiments of the present disclosure.

As shown in FIG. 5 and other figures, the sear 20 is formed with a body 50 having a bored opening 52 and an extension base 54 formed with a foot 55 having an opening 56 opposed to opening 52, wherein a sear spring 58 can be positioned between the body 50 and extension base 54 and a sear pin 59 can be inserted through the openings 52, 56 and the sear spring 58. The sear 20 is formed with an extension arm 80 extending substantially perpendicularly above the bored opening 52 and proximate a first end 81 of the body 50. The extension arm 80 is formed with a first hook 82 having a top jaw surface 83, which slidingly engages the latching edge 49 of the hammer 18 during operation of the firing mechanism as described elsewhere herein. The sear 20 is further formed with a second hook 84 proximate a second end 85 of the body 50, wherein the second hook 84 can be provided with a generally C-shaped cross-section and an actuator-engaging head 87. The inner surface 88 of the second hook 84 forms a slot 89 wherein portions of an actuator arm 62 of the actuator 22 may reside during different operations of the firing mechanism of the present disclosure. The outer surface 57 of the second hook 84 can engage trailing edge 142 of the inner portion of the hammer 18 during operation, as described elsewhere herein. This engagement between outer surface 57 of the second hook 84 and the trailing edge 142 of the hammer 18 provides a secondary interface 99 in accordance with embodiments of the present disclosure.

Figure 6:
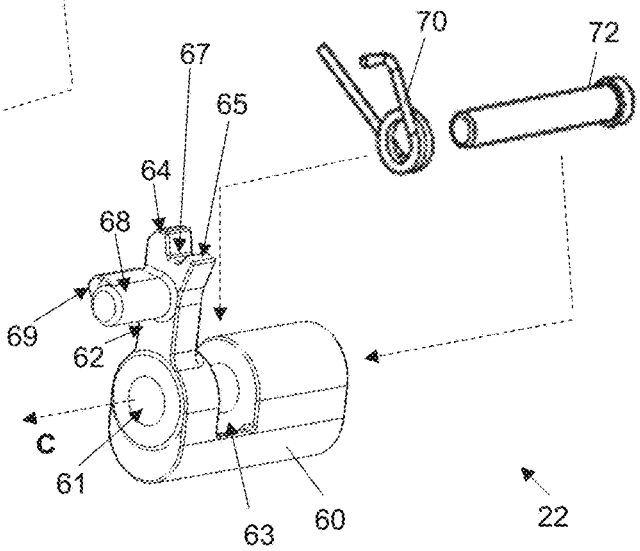
FIG. 6 is an exploded perspective view of an actuator according to embodiments of the present disclosure.
Figure 11:
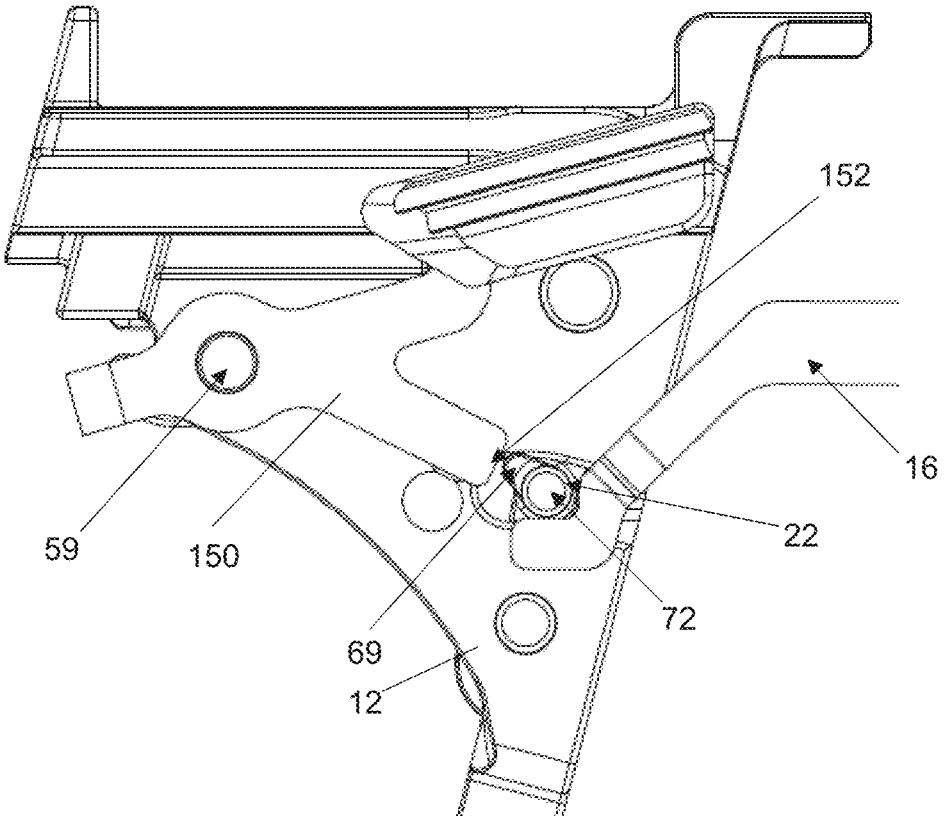

As shown in FIG. 6 and other figures, the actuator 22 is formed with an actuator base 60 and an actuator arm 62 extending radially outwardly of the actuator base 60, wherein the actuator base 60 includes an actuator bore 61 extending axially therethrough. The actuator base 60 can be formed with a spring slot 63 and the actuator arm 62 can be formed with a pair of opposed prongs 64, 65 forming a notch 67 therebetween. The actuator arm 62 can further be formed with an extension rod 68 extending substantially perpendicularly therefrom, and an actuator interface 69 extends radially outwardly from the extension rod 68. The spring slot 63 is sized to receive an actuator spring 70, and an actuator pin 72 extends through the actuator bore 61 and through the actuator spring 70. In various embodiments, the actuator interface 69 extends from the actuator arm 62 for manually blocking the actuator 22 from separating from the sear 20. This is illustrated in FIG. 11, where a safety lever 150 engages actuator interface 69 at edge 152. As the safety lever 150 is secured about and engaged with sear pin 59, any restriction on the rotation of the safety lever 150 will restrict the rotation of the sear 20.

Figure 7:
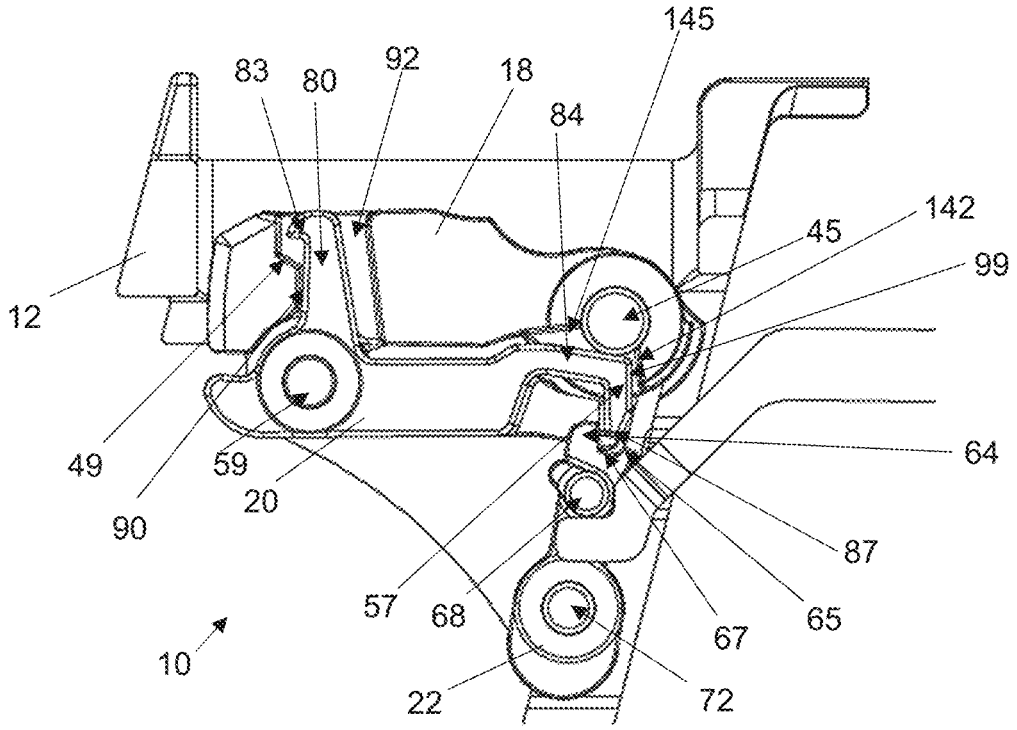
FIGS. 7 through 11 are partial cross-sectional views of a firing mechanism according to embodiments and different stages of the present disclosure.
Figure 8:
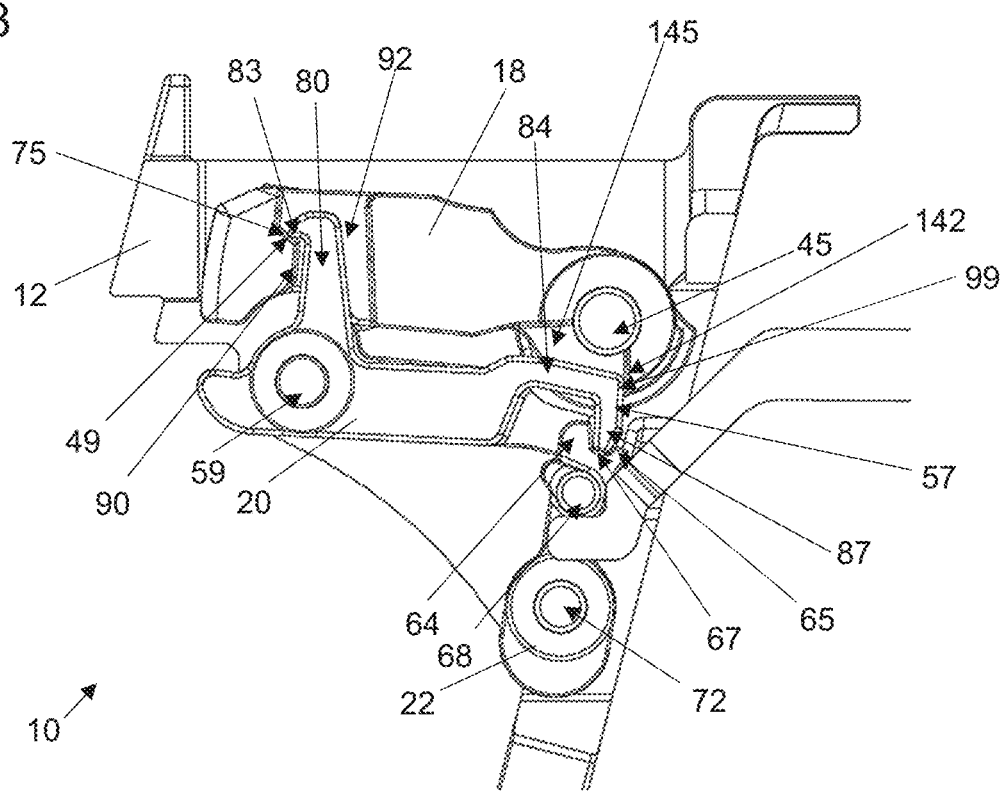

The frame or housing 12 is provided with opposing hammer pin openings 31, sear pin openings 32 and actuator pin openings 33 for receiving the hammer pin 45, sear pin 59 and actuator pin 72, respectively. This enables the hammer 18 to be pivotably mounted about a hammer pin axis A, sear 20 to be pivotably mounted about a sear pin axis B and actuator base 60 to be pivotably mounted about an actuator axis C. When installed in the frame or housing 12, the hammer spring 44 biases the hammer 18 against the frame or housing 12 so that the hammer 18 is inclined to rotate clockwise with sufficient force to carry out its duty to forcibly strike a firing pin when the trigger 15 is pulled. When installed in the frame or housing 12, the sear spring 58 biases the sear 20 against the frame or housing 12 so that the sear 20 is inclined to rotate counterclockwise. A primary interface 75 is operably formed between the top jaw surface 83 of the first hook 82 of the sear 20 and the latching edge 49 of the hammer head segment 46 of the hammer 18. The sear spring 58 biases the first hook 82 into the primary interface 75 and biases the second hook 84 towards the hammer 18. The hammer spring 44 biases the hammer 18 into the primary interface 75 and is operable to overcome the biasing of the sear spring 58. Additionally, when installed in the frame or housing 12, the actuator spring 70 biases the actuator 22 against the frame or housing 12 so that the actuator 22 is inclined to rotate clockwise. In various embodiments, the actuator 22 is prevented from rotating due to the actuator-engaging head 87 of the second hook 84 of the sear 20 being positioned in the notch 67 between the prongs 64, 65 of the actuator arm 62, as shown in FIGS. 7 and 8, for example.

During ordinary operation with all parts intact, when a user pulls trigger 15, the trigger bar 16 pushes the extension rod 68 of the actuator 22, causing the actuator to rotate about axis C against its bias in a counterclockwise direction. Such rotation causes the actuator-engaging head 87 of the second hook to slide past prong 65 and then the spring force of the hammer spring 44 overcomes the resistance from the sear spring 58 such that the top jaw surface 83 of the first hook 82 of the sear 20 slides down the latching edge 49 and thereby releases the hammer 18 so that the hammer 18 can strike the firing pin. The trigger 15 is thus operable to rotate the actuator 22 about the actuator axis C (represented by actuator pin 72 location in FIGS. 7 through 10) to disengage the second hook 84 of the sear 20 from the notch 67 of the actuator arm 62, thereby permitting the first hook 82 of the sear 20 to release the hammer 18 and permit the firearm to be discharged. At this time, both prongs 64, 65 of the actuator 22 are positioned in the slot 89 of the second hook 84 of the sear 20.

Subsequent to firing the firearm, the slide (not shown) is racked to reset the hammer, whereupon the slide engages the hammer body 40 and overcomes the biasing force of the hammer spring 44 to re-engage the top jaw surface 83 of the first hook 82 of the sear with the latching edge 49 of the hammer head segment 46 of the hammer 18. As the sear rotates counterclockwise about its axis while the slide is re-racked, the second hook 84 is lifted away from the actuator prongs 64, 65, allowing the actuator 22 to rotate clockwise about its axis so that the prongs 64, 65 align around the actuator-engaging head 87. As the re-racking process is complete and the slide finishes engagement with the hammer 18, the hammer rotates slightly back in the clockwise direction, whereupon the actuator-engaging head 87 rotates to a position within the notch 67 between prongs 64, 65. FIG. 7 illustrates the position where the top jaw surface 83 of the hammer 18 is not engaged with the latching edge 49 of the sear 20, and FIG. 8 illustrates the position where the top jaw surface 83 of the hammer 18 is engaged with the latching edge 49 of the sear 20, thereby providing the primary interface 75. It will be appreciated that the hammer spring 44 pulls the hammer 18 upwards which causes a force on the sear 20 to push into the actuator 22. While the sear spring 58 acts to push the sear 20 upwards, this force is overcome by the load applied through the primary interface 75. The result is that the sear 20 is pushed down on the actuator 22. In FIGS. 7 and 8, the secondary interface 99 is indicated at the point of contact of the outer surface 57 of the second hook 84 and the trailing edge 142 of the hammer 18.

Figure 9:
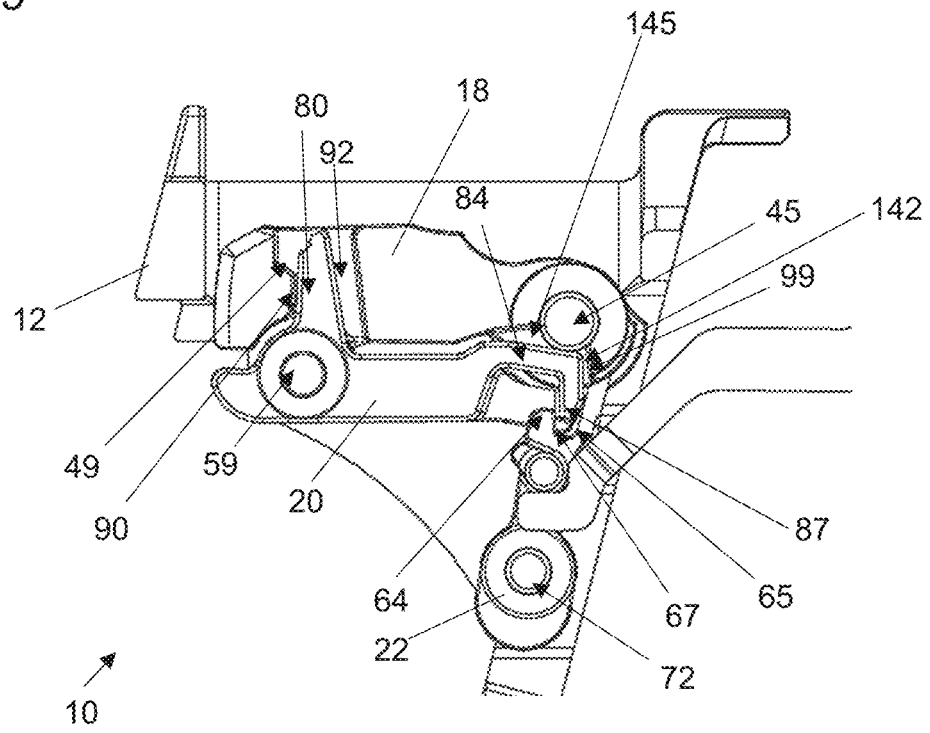
Figure 10:
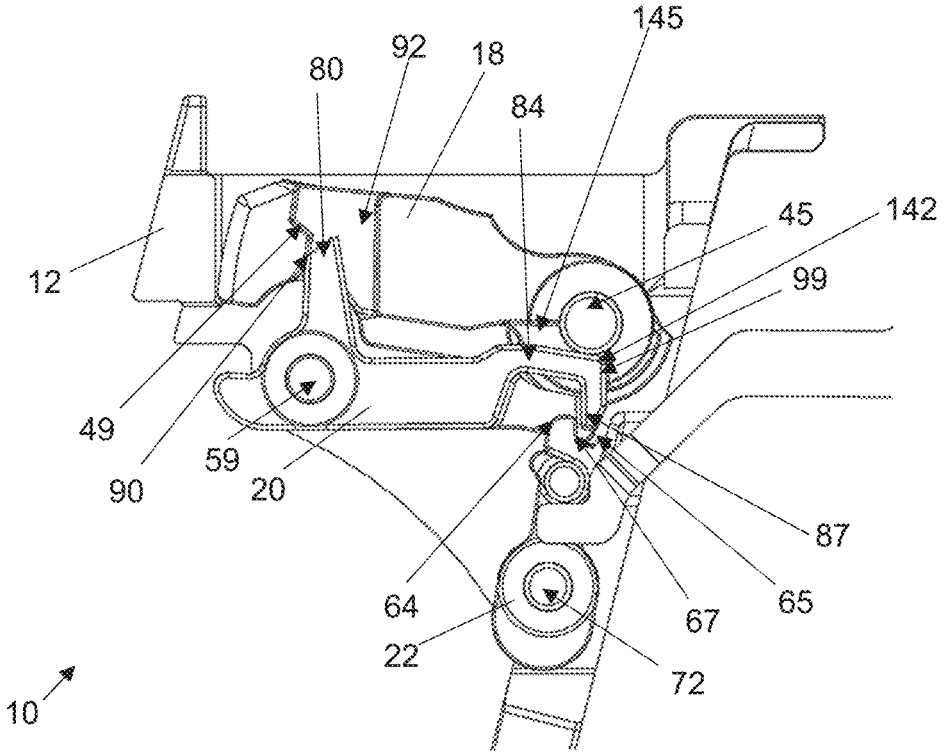

In the instance of a failure of the primary interface 75 as illustrated in FIGS. 9 and 10, for example, where the first hook 82 has broken off, there is no surface such as top jaw surface 83 (shown in FIGS. 7 and 8) to engage the latching edge 49 of the hammer 18. In such instance, the hammer 18 is no longer retained by the sear 20 and the hammer will rotate clockwise (towards a firing pin) until the secondary interface 99 engages. The sear spring 58 pushes the sear 20 upward to help maintain the interaction on the secondary interface 99. The sear 20 may still rest on the actuator 22, or slightly lift off the contact surface as shown in FIGS. 9 and 10. At this stage, the secondary interface 99 between the hammer 18 and the sear 20 will not be separated unless the firing mechanism 10 is removed from the firearm.

Once the primary interface 75 has failed and the secondary interface 99 has engaged, an outside action applied to the fire control such as a user pulling the trigger 15 will not result in the hammer 18 releasing towards the firing pin. On the other hand, the sear 20 may be pushed farther into engagement with the hammer 18 at the secondary interface 99. Further, an outside action such as a user racking the slide to reset the hammer 18 will result in the hammer 18 being rotated to its lowest position, relieving the pressure on the interface 99. The sear spring 58 rotates the sear 20 to its most upward position before the hammer 18 is released under the slide and applies pressure again. At this point, any interaction with the actuator 22 is impossible and the shooter will experience a "dead trigger". It will thus be appreciated that the failure of the first hook 82 and/or first interface 75 renders the trigger 15 inoperable for discharging the firearm. The secondary interface 99 thus prevents an accidental discharge of the firearm in case of failure of a part such as the sear 20 and further locks the firing mechanism in a condition where the user cannot fire another round but can safely unload and disassemble the firearm for troubleshooting.

It will be appreciated that the primary interface 75 and the secondary interface 99 are at different distances from the sear axis B. As shown in FIGS. 7 through 10, the secondary interface 99 is farther than the primary interface 75 from the sear axis B (represented by sear pin 59 location) to ensure it will disengage first and will not inhibit the normal operation of the firing mechanism. Further, the alignment of the interfaces 75, 99 on the hammer are opposite. As shown in FIGS. 7 through 10, the primary interface 75 is farther away from the hammer axis A (represented by hammer pin 45 location) than the secondary interface 99 to allow the hammer spring 44 to create a larger force on the sear 20 and force the disconnect once the actuator 22 is moved out of the way.

It will be appreciated that many substitutions and modifications may be made in the foregoing description and accompanying drawings without departing from the spirit and scope of the present disclosure.

The invention claimed is:

1. A firing mechanism, comprising:

a hammer pivotably mounted about a hammer axis;

a sear pivotably mounted about a sear axis, wherein the sear comprises a first hook operable to provide a primary interface with the hammer;

an actuator comprising an actuator base and an actuator arm extending radially outwardly from the actuator base, wherein the actuator base is pivotably mounted about an actuator axis;

wherein the sear further comprises a second hook operable to provide a secondary interface with the hammer and wherein, upon failure of the first hook, the second hook secures the hammer and prevents discharge of the firearm; and wherein the actuator arm comprises a notch and further comprising a trigger operable to rotate the actuator about the actuator axis to disengage the second hook of the sear from the notch of the actuator arm, thereby permitting the first hook of the sear to release the hammer and permit the firearm to be discharged.

2. The firing mechanism of claim 1, wherein the primary interface is a first distance from the sear axis and the secondary interface is a second distance from the sear axis, and further wherein the first distance is smaller than the second distance.

3. The firing mechanism of claim 1, further comprising a sear spring biasing the first hook into the primary interface and biasing the second hook towards the hammer.

4. The firing mechanism of claim 3, further comprising a hammer spring biasing the hammer into the primary interface and operable to overcome the biasing of the sear spring.

5. The firing mechanism of claim 1, wherein the failure of the first hook renders the trigger inoperable for discharging the firearm.

6. The firing mechanism of claim 1, wherein the actuator arm comprises a first prong and a second prong defining the notch.

7. The firing mechanism of claim 1, wherein the hammer comprises a leg formed with a wider depth portion and a narrower depth portion, wherein an internal wall on the narrower depth portion extends between a leading edge and a trailing edge of the wider depth portion, wherein the second hook comprises an outer surface, and wherein the second hook outer surface and the trailing edge of the wider depth portion of the sear are operable to provide the secondary interface.

8. A firing mechanism, comprising:

a hammer pivotably mounted about a hammer axis;

a sear pivotably mounted about a sear axis, wherein the sear comprises a first hook operable to provide a primary interface with the hammer, wherein the sear further comprises a second hook operable to provide a secondary interface with the hammer, wherein the primary interface is a first distance from the sear axis and the secondary interface is a second distance from the sear axis, and further wherein the first distance is smaller than the second distance;

an actuator pivotably mounted about an actuator axis; and wherein the firing mechanism further comprises a trigger operable to rotate the actuator about the actuator axis to disengage the second hook of the sear from the actuator, thereby permitting the first hook of the sear to release the hammer and permit the firearm to be discharged, wherein, upon failure of the first hook, the second hook secures the hammer and prevents discharge of the firearm.

9. The firing mechanism of claim 8, further comprising a sear spring biasing the first hook into the primary interface and biasing the second hook towards the hammer.

10. The firing mechanism of claim 9, further comprising a hammer spring biasing the hammer into the primary interface and operable to overcome the biasing of the sear spring.

11. The firing mechanism of claim 8, wherein the failure of the first hook renders the trigger inoperable for discharging the firearm.

12. The firing mechanism of claim 8, wherein the hammer comprises a leg formed with a wider depth portion and a narrower depth portion, wherein an internal wall on the narrower depth portion extends between a leading edge and a trailing edge of the wider depth portion, wherein the second hook comprises an outer surface, and wherein the second hook outer surface and the trailing edge of the wider depth portion of the sear are operable to provide the secondary interface.

13. A firing mechanism, comprising:

a frame or housing;

a hammer secured within the frame or housing and pivotably mounted about a hammer axis;

a sear secured within the frame or housing and pivotably mounted about a sear axis, wherein the sear comprises a first hook operable to provide a primary interface with the hammer and a second hook operable to provide a secondary interface with the hammer;

an actuator secured within the frame or housing and pivotably mounted about an actuator axis, wherein the actuator comprises a notch operable to engage the second hook of the sear;

a trigger operable to rotate the actuator about the actuator axis to disengage the second hook of the sear from the actuator, thereby permitting the first hook of the sear to release the hammer and permit the firearm to be discharged; and wherein, upon failure of the first hook, the second hook secures the hammer and prevents discharge of the firearm.

14. The firing mechanism of claim 13, wherein the failure of the first hook renders the trigger inoperable for discharging the firearm.

15. The firing mechanism of claim 13, wherein the primary interface is a first distance from the sear axis and the secondary interface is a second distance from the sear axis, and further wherein the first distance is smaller than the second distance.

16. The firing mechanism of claim 13, further comprising a sear spring biasing the first hook into the primary interface and biasing the second hook towards the hammer.

17. The firing mechanism of claim 16, further comprising a hammer spring biasing the hammer into the primary interface and operable to overcome the biasing of the sear spring.

18. The firing mechanism of claim 13, wherein the actuator comprises an actuator base and an actuator arm extending radially outwardly from the actuator base, wherein an interface extends from the actuator arm for manually blocking the actuator from separating from the sear.

* * * * *